US008287298B2

(12) United States Patent
Hsu et al.

(10) Patent No.: US 8,287,298 B2
(45) Date of Patent: Oct. 16, 2012

(54) DETACHMENT-PREVENTING PLUG

(75) Inventors: Jung-Hui Hsu, Taipei County (TW); Chen-Teng Hsu, Taipei County (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 37 days.

(21) Appl. No.: 12/907,203

(22) Filed: Oct. 19, 2010

(65) Prior Publication Data

US 2012/0034807 A1 Feb. 9, 2012

(30) Foreign Application Priority Data

Aug. 4, 2010 (TW) ..... 99125951 A

(51) Int. Cl.
*H01R 13/62* (2006.01)

(52) U.S. Cl. ..... 439/352; 439/373

(58) Field of Classification Search ..... 439/352, 439/357, 346, 373, 358
See application file for complete search history.

(56) References Cited

U.S. PATENT DOCUMENTS 3,985,415 A * 10/1976 Wolpert et al. ..... 439/270
4,345,122 A * 8/1982 Janniello ..... 200/50.29
4,361,375 A * 11/1982 Bailey et al. ..... 439/357
4,954,097 A * 9/1990 Sekiguchi ..... 439/352
7,347,708 B1 * 3/2008 Huang ..... 439/346

* cited by examiner

*Primary Examiner* — Gary F. Paumen
(74) *Attorney, Agent, or Firm* — Rosenberg, Klein & Lee

(57) ABSTRACT

A detachment-preventing plug for hooking a socket is provided. The detachment-preventing plug comprises a body unit, two conducting pins, a slider member and two resilient hooking members. The body unit has a compartment for receiving the slider member. Each of the resilient hooking members has a protruding portion and an exposing hooking end. Each of the protruding portions protrudes toward the slider member and is engaged with the slider member, and a hooking portion is formed on each of the exposing hooking ends. The two conducting pins have two slots respectively. When the two conducting pins are inserted into the socket, the two resilient hooking members are adapted to pass through the two slots and hook the socket by the two hooking portions, wherein a user could drive the slider to make the two resilient hooking members establish a releasing configuration or a hooking configuration.

8 Claims, 6 Drawing Sheets

DETACHMENT-PREVENTING PLUG

BACKGROUND OF THE INVENTION

1. Field of the Invention

The present invention relates to a detachment-preventing plug; in particular, the invention relates to a detachment-preventing plug without a corresponding socket.

2. Description of the Related Art

Conventional detachment-preventing devices are often disposed on sockets rather than on the plugs. For example, FIG. 1 shows a conventional locking frame disposed outside the socket, and the frame defines a compartment for receiving a plug. The drawback of such conventional design is that the compartment defined by the frame must correspond with the size of the plug, or the frame can't strengthen the fixing capability. Furthermore, the frame occupies a certain space, and the usages of the electric equipments are restricted within the place having the special socket. In other words, the electric equipments do not have the detachment-preventing function, which are carried by a user to the place without the special socket.

Based on research, the inventor proposes the present invention to address the above issues.

SUMMARY OF THE INVENTION

The object of the instant disclosure is to provide a detachment-preventing plug, a hooking portion formed on a resilient hooking member, and the hooking portion passes through a slot of a conducting pin and establishes a hooking configuration with a socket, therefore, the fixing capability of the detachment-preventing plug with a socket is improved.

The instant disclosure has following benefits: due to the detachment-preventing plug comprises an resilient hooking member used for hooking a socket, and the resilient hooking member has the advantage of tiny size, furthermore, the detachment-preventing plug doesn't collocate with a special socket any more.

In order to further appreciate the characteristics and technical contents of the present invention, references are hereunder made to the detailed descriptions and appended drawings in connection with the present invention. However, the appended drawings are merely shown for exemplary purposes, rather than being used to restrict the scope of the present invention.

DETAILED DESCRIPTION OF THE PREFERRED EMBODIMENT

Figure 1:
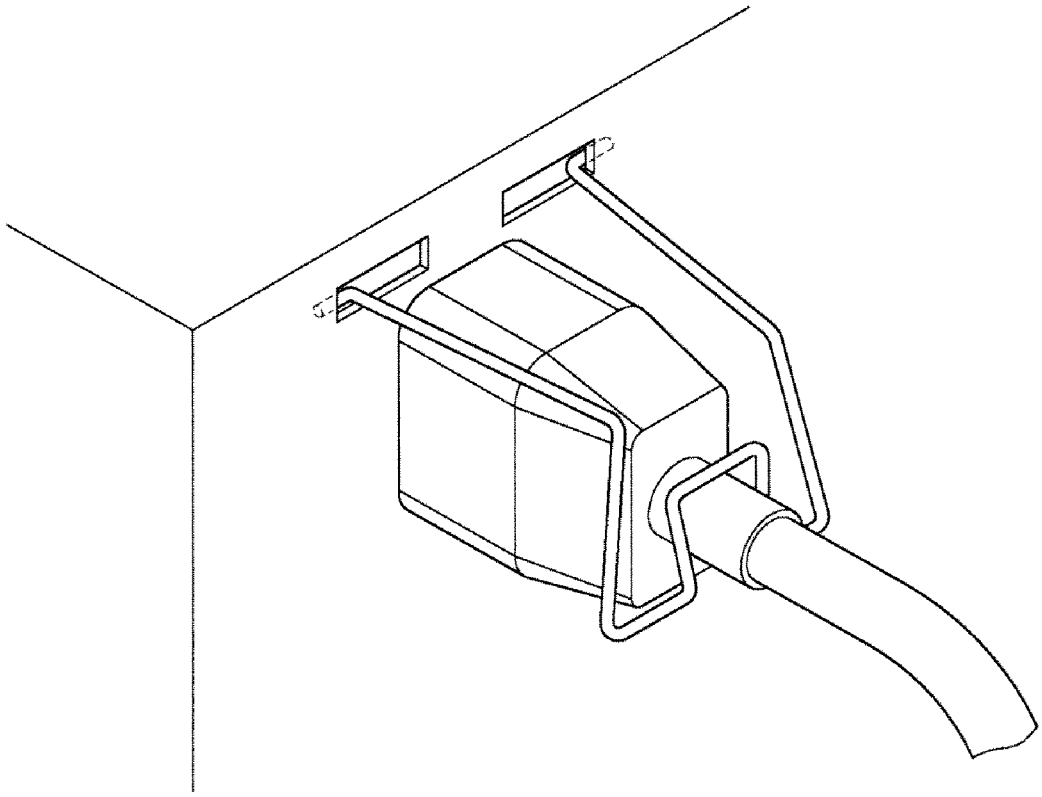
FIG. 1 PRIOR ART
FIG. 1 is a schematic perspective view of a conventional detachment-preventing socket.
Figure 2:
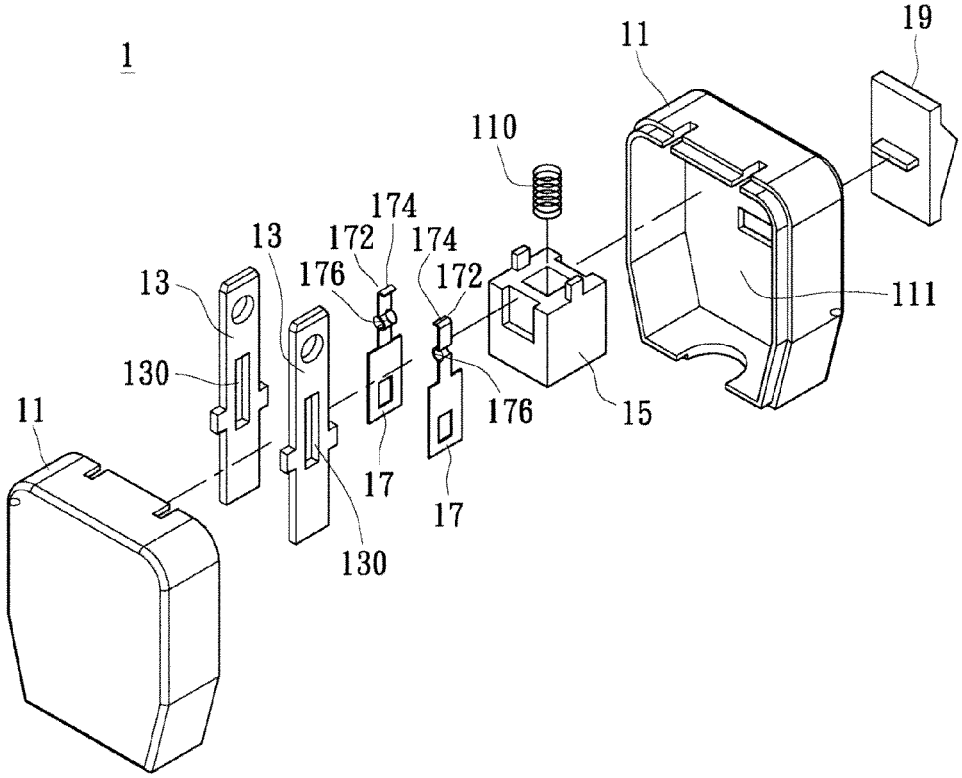
FIG. 2 shows a exploded view of the detachment-preventing plug of the first embodiment of the present invention.

Referring to FIG. 2, which shows the detachment-preventing plug of the first embodiment of the invention. The detachment-preventing plug 1 comprises a body unit 11, a first and a second conducting pins 13, a slider member 15, a first and a second resilient hooking member 17 and a button 19. Wherein, the two conducting pins 13 have a slot 130 respectively, and the body unit 11 has an interior compartment. Furthermore, the two conducting pins 13 are partially exposedly disposed in the interior compartment of the body unit 11 and match the size of the inserting holes of the general sockets, and the slider member 15 is slidably disposed in the interior compartment of the body unit 11. The slider member 15 is disposed between the first resilient hooking member and the second resilient hooking member 17, and the first resilient hooking member and the second resilient hooking member 17 are adjacent to a lateral of the first conducting pin and the second conducting pin 13. In other words, the resilient hooking member 17 is partially exposedly disposed in the body unit 11 and immediately between the conducting pin 13 and the slider member 15. The first resilient hooking member and second resilient hooking member 17 have a protruding portion 176 and an exposing hooking end 172 respectively, and the protruding portions 176 protrude toward the abutting surface of the slider member 15. The exposing hooking end 172 of the resilient hooking members 17 correspondingly align the slots 130 of the conducting pins 13. Further, a hooking portion 174 is formed on the exposing hooking end 172, and the button 19 connects to the slider member 15.

Figure 3A:
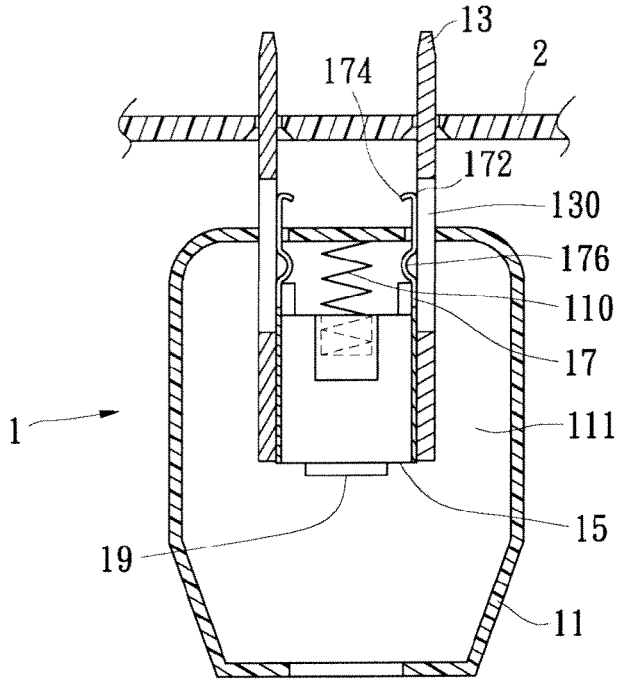
FIG. 3A shows a sectional view of a detachment-preventing plug of the first embodiment of the present invention.
Figure 3B:
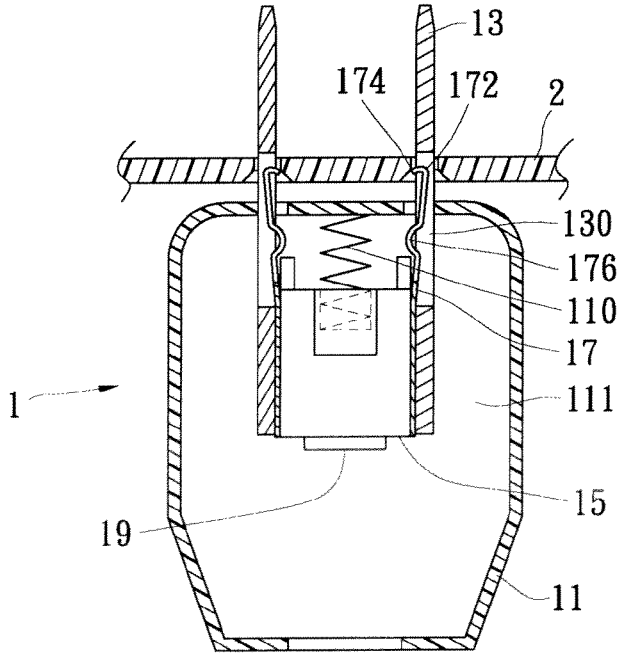
FIG. 3B shows a sectional view of a detachment-preventing plug of the first embodiment of the present invention.
Figure 3C:
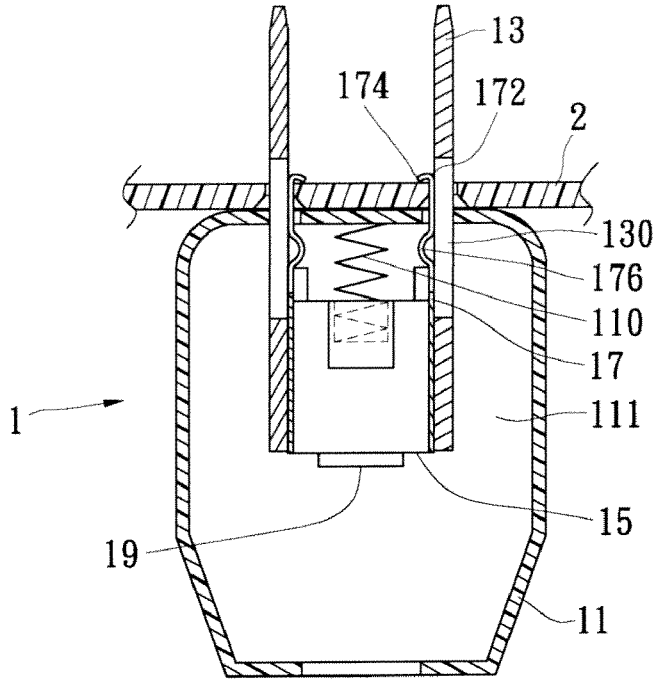
FIG. 3C shows a sectional view of a detachment-preventing plug of the first embodiment of the present invention.
Figure 3D:
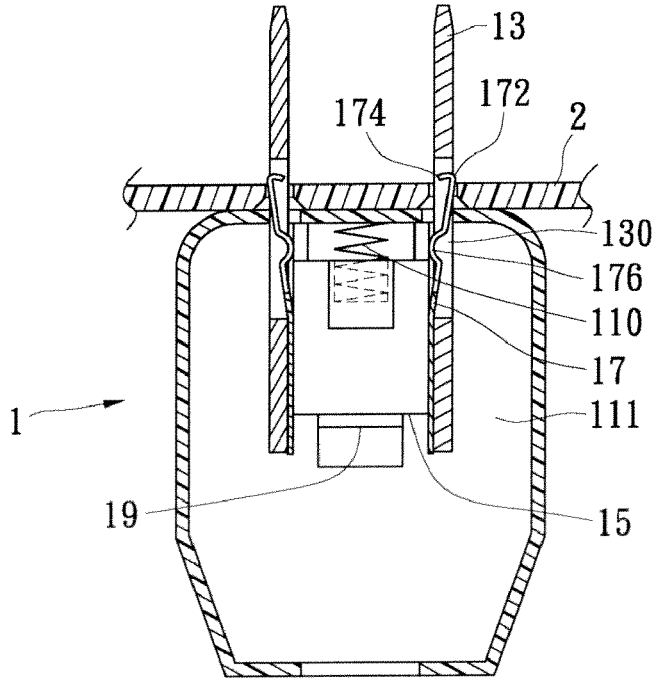
FIG. 3D shows a sectional view of a detachment-preventing plug of the first embodiment of the present invention.

Please referring to FIGS. 3A to 3D, the detachment-preventing plug 1 starts inserting into the socket 2. At this moment, the protruding portions 176 haven't been biased by the slider member 15, and the hook portion 174 haven't entered the slot 130. As shown in FIG. 3B, when the detachment-preventing plug 1 is being inserted into the socket 2, the resilient hooking member 17 is against the socket 2, so that the hooking portion 174 of the resilient hooking member 17 is biased by the socket 2 and the exposing hooking end 172 of the resilient hooking member 17 is entering to the slot 130. In the meantime, the obstruction disappears, and the detachment-preventing plug 1 could be inserted into the socket 2 completely. As shown in FIG. 3C, when the detachment-preventing plug is inserted into the socket 2 completely, the hooking portion 174 is biased by the socket 2 no more. The exposing hooking end 172 gets away from the slot 130 by the elastic restoring force so that the resilient hooking member 17 establishes a hooking configuration upon the insertion of the first and the second conducting pins 13 into the socket slot. As shown in FIG. 3D, a user could pull out the detachment-preventing plug by pushing the button 19, in this way, the slider member 15 is against the protruding portion 176. With this arrangement, the exposing hooking end 172 of the resilient hooking member 17 is biased toward and entering the slot 130 so as to lift the hooking portion 174 to establish a releasing configuration. In other words, when the protruding portion 176 of the resilient hooking member 17 is pushed by the abutting surface of the slider member 15, the resilient hooking member 17 establishes a releasing configuration upon the deflection of the exposing hooking end 172 into the slot 130 of the conducting pins 13. Furthermore, the body unit 11 further comprises an elastic element 110, two opposite ends of the elastic element 111 connect to the body unit 11 and the slider 15 respectively, so that the elastic element 110 holds the slider in the initial position. When the user motives the slider 15 by pushing the button 19, the elastic element 110 is compressed and an elastic energy is restored. When the user sets free the button 19, the external force is removed so that the restored elastic energy is released, and the slider member 15 returns to the initial position.

Furthermore, the interrelationships between the slider member 15 and the resilient hooking member 17 are further described herein. In order to make the resilient hooking member 17 effect in the deep inserting hole, the resilient hooking member 17 may go deep into the deep inserting hole by the interrelationships between the slider member 15 and the protruding portion 176. When the slider member 15 is subjected to a thrust force along a inserting direction, the slider member 15 received in the compartment 111 is adapted to thrust the protruding portion 176 and drive the resilient hooking member 17 moving along the inserting direction. Thus, the resilient hooking member 17 goes deep into the deep inserting hole to make the hooking portion 174 hooks the socket 2. Then, if the move of the resilient hooking member 17 is restricted by the body unit 11 or the socket 2, but the slider member 15 is still keeping moving, the slider member 15 will bias the protruding portion 176 so as to make the exposing hooking end 172 of the resilient hooking member 17 enter the slot 130 to establish a releasing configuration. It should be noted herein that the resilient hooking member 17 is disposed between the slider member 15 and the conducting pin 13, the resilient hooking member 17 does not fasten to any other elements by any fixing methods.

Figure 4A:
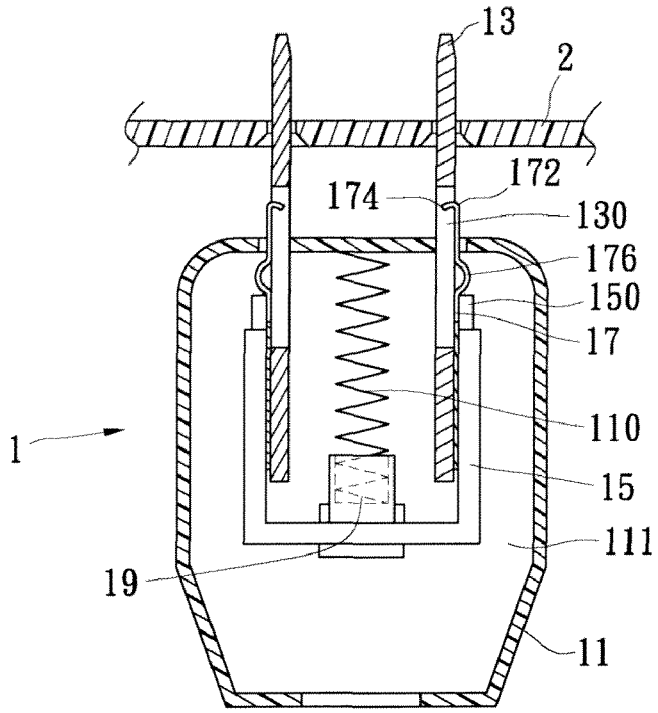
FIG. 4A shows a sectional view of a detachment-preventing plug of the second embodiment of the present invention.
Figure 4B:
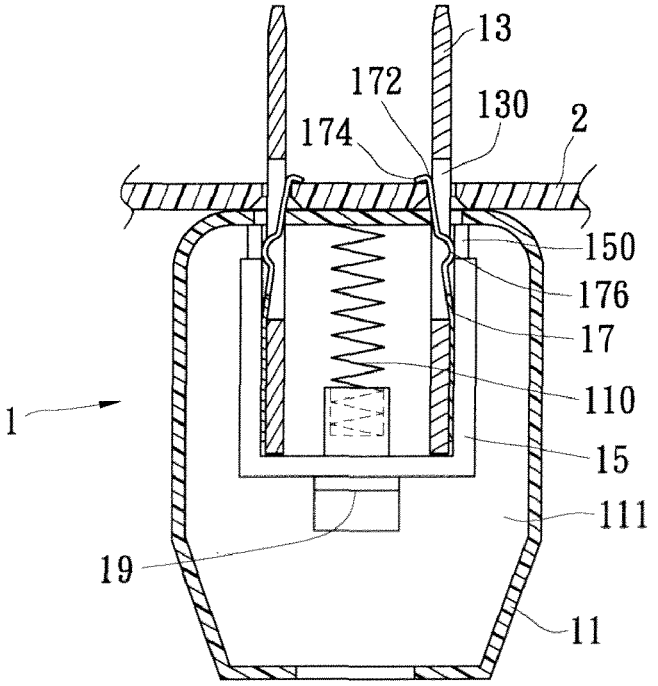
FIG. 4B shows a sectional view of a detachment-preventing plug of the second embodiment of the present invention.

Referring to FIGS. 4A and 4B is the second embodiment of the detachment-preventing plug of the present invention. The first resilient hooking member and the second resilient hooking member 17 of detachment-preventing plug 1 are disposed on a lateral of the first conducting pin and the second conducting pin 13. Wherein, the slider member 15 has a first engaging end and a second engaging end 150 extending toward the laterals of the resilient hooking members 17, which is slidably disposed in the interior compartment of the body unit 11 around the outer peripheral of the conducting pins 13, and adapted to clip the resilient hooking member 17 with conducting pin 13. The resilient hooking member 17 has a protruding portion 176 and an exposing hooking end 172 protruding toward the abutting surface of the slider member 15 and engaging with the engaging end 150. An exposing hooking end 172 is formed on an end of the resilient hooking member 17 far away from the body unit 11. A hooking portion 174 is formed on the exposing hooking end 172, which is adapted to hook the socket 2 through the slot 130. As shown in FIG. 4A, the detachment-preventing plug has not been inserted into the socket 2 completely. When the detachment-preventing plug 1 is inserted into the socket 2, the hooking portion 174 will not be biased by the socket 2, because the exposing hooking end 172 of the resilient hooking member 17 is adapted to be received in the slot 130. Therefore, the detachment-preventing plug is inserted into the socket 2 easily. As shown in FIG. 4B, the detachment-preventing plug is inserted into and hooking the socket 2 completely. In order to make the hooking portion 174 hook the socket 2, the user pushes the button 17 to drive the slider member 15, and the protruding portion 176 moves toward the slot 130 by the engaging end 150 biasing the protruding portion 176 of the resilient hooking member 17. Further, the exposing hooking end 172 of the resilient hooking member 17 goes away from the slot 130 and the hooking portion 174 hooks the socket 2. Wherein, when the protruding portion 176 of the resilient hooking member 17 is pushed by the abutting surface of the slider member 15, the resilient hooking member 17 establishes a hooking configuration upon the deflection of the exposing hooking end 172 into the slot 130 of the conducting pin 13. Moreover, people skilled in this field may proceed with a variety of fixing device (not shown, it is not restricted herein) in the detachment-preventing plug 1 to fix the slider member 15 to the body unit 11. With this arrangement, the protruding portion 176 keeps being biased and makes the detachment-preventing plug 1 and the socket 2 establish a hooking configuration. In addition, the body unit 11 further comprises an elastic element 110, two opposite ends of the elastic element 111 connect to the body unit 11 and the slider member 15 respectively, and the elastic element 110 holds the slider member 15 in the initial position. When the user motives the slider member 15 by pushing the button 19, the elastic element 110 is compressed and an elastic energy is restored. When the user sets free the fixing device, the external force is removed, the restored elastic energy is released, and the slider member 15 returns to the initial position.

Furthermore, the interrelationships between the slider member 15 and the resilient hooking member 17 are further described herein. In order to make the resilient hooking member 17 effect in the deep inserting hole, the resilient hooking member 17 may go deep into the deep inserting hole by the interrelationships between the slider member 15 and the protruding portion 176. When the slider member 15 is subjected to a thrust force along an inserting direction, the engaging end 150 is adapted to thrust the protruding portion 176 and the drive the resilient hooking member 17 moving along the inserting direction. Thereby, the resilient hooking member 17 goes deep into the deep inserting hole. Then, if the move of the resilient hooking member 17 is restricted by the body unit 11 or the socket 2, but the slider member 15 is still keeping moving, the slider member 15 will bias the protruding portion 176 so as to make the exposing hooking end 172 of the resilient hooking member 17 go away from the slot 130 to establish a hooking configuration. It should be noted herein that the resilient hooking member 17 is disposed between the slider member 15 and the conducting pin 13, the resilient hooking member 17 does not fasten to any other elements by any fixing methods.

Figure 5A:
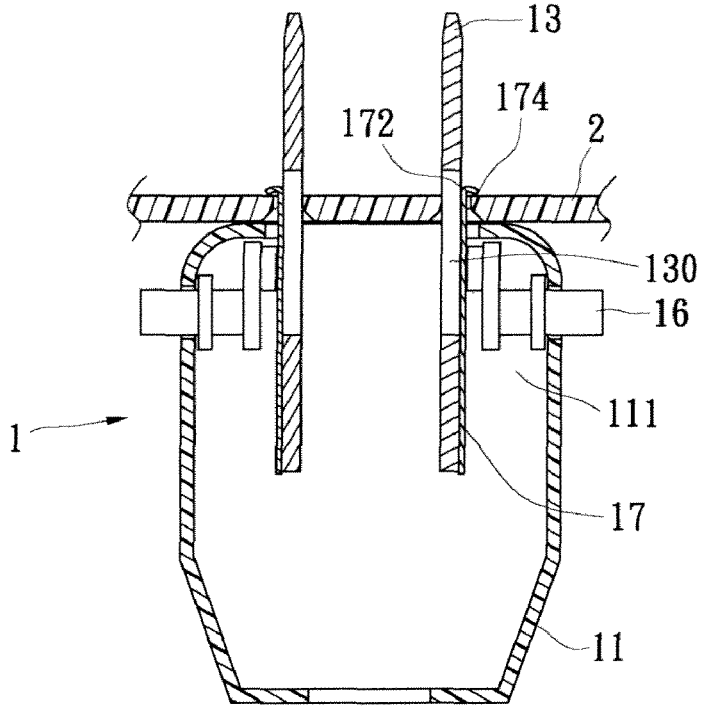
FIG. 5A shows a sectional view of a detachment-preventing plug of the third embodiment of the present invention.
Figure 5B:
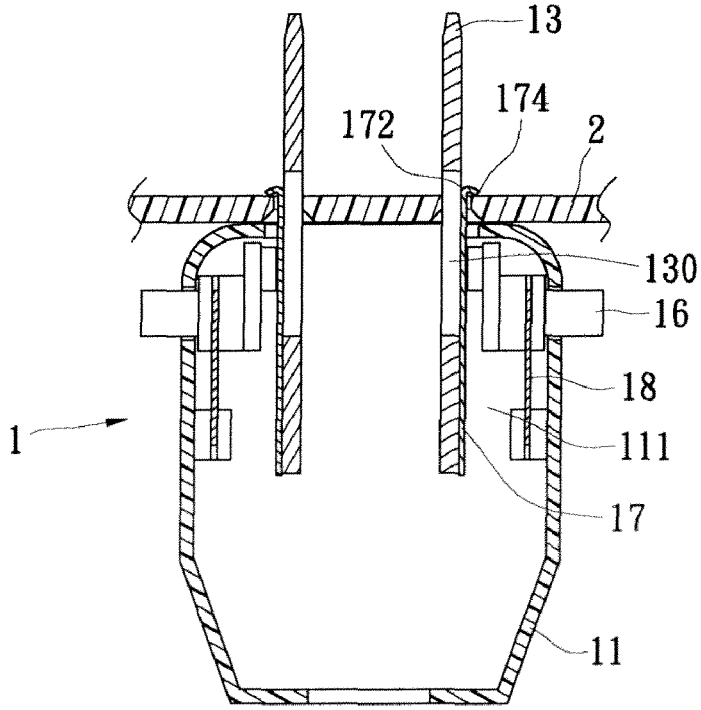
FIG. 5B shows a sectional view of a detachment-preventing plug of the third embodiment of the present invention.

Referring to FIGS. 5A and 5B, which shows the third embodiment of the detachment-preventing plug 1 of the invention. The detachment-preventing plug 1 comprises a body unit 11, a first and a second conducting pins 13, a first resilient hooking member and a second resilient hooking member 17, and a first pressing member and a second pressing member 16. Wherein, the conducting pins 13 are partially exposedly disposed in the interior compartment of the body unit 11, and the conducting pins 13 have a slot 130 respectively at least partially exposed from the body unit 11. The first resilient hooking member and the second resilient hooking member 17 are partially exposedly disposed in the body unit 11 immediately between the conducting pins 13 and the pressing member 16. The resilient hooking member 17 has an exposing hooking end 172 formed on an end of the resilient hooking member 17 far away from the body unit 11, wherein the exposing hooking end 172 of the resilient hooking member 17 correspondingly aligns the slot 130 of the conducting pin 13, and a hooking portion 174 is formed on the exposing hooking end 172, which is adapted to pass through the slot 130 and hook the socket 2. The pressing portion 16 penetrates through the body unit 11, touches a lateral surface of the resilient hooking member 17 opposite to the conducting pin 13 and is partially received in the compartment 111. As to the actuation of the third embodiment of the detachment-preventing plug 1 of the invention, is similar to the actuation of the first embodiment, it is not described herein. As shown in FIG. 5A, the detachment-preventing plug is inserted into the socket 2 completely and establishes a hooking configuration. If the user wants to lift the hooking configuration between the detachment-preventing plug 1 and the socket 2, the user can press the pressing portion 16. The pressing members 16 are partially exposed from the body unit 11, and have an exposing pressing end and an internal pushing end. The internal pushing end of the pressing member 16 is substantially corresponds to the slot 130 of the conducting pin 13, adapted to bias the resilient hooking member 17 and make the exposing hooking end 172 move toward and the slot 130. And then, the resilient hooking member 17 is pushed by the internal pushing end of the pressing member 16 so that the hooking portion 174 enters the slot 130 to establish a releasing configuration upon the deflection of the exposing hooking end 172 into the slot 130 of the conducting pin 13. When the user removes the pressing force, the elastic energy of the deformation of the resilient hooking member 17 is released so that the pressing portion 16 is against by the resilient hooking member 17 and back to the initial position.

In addition, as shown in FIG. 5B, the detachment-preventing plug 2 further comprises a return device 18, generally speaking, the return device is an elastic body, and a strip-shaped is better. Two opposite ends of the return device 18 are fastened to the body unit 11 and pressing portion 16 respectively. A groove (not shown) is defined by the body unit 11 and the pressing portion 16 respectively, which is adapted to receive the two opposite ends of the return device 18. Thereby, the return device is adapted to be against the pressing portion 16 to the initial position. When the pressing portion 16 is subjected to the pressing force along the direction perpendicular to the inserting direction, the return device 18 deformed as the displacement of the pressing portion and an elastic energy is restored. When the user removes the pressing force, the elastic energy of the deformation of the return device 18 is released so that the return device 18 returns so as to be against to the pressing portion 16 back to the initial position.

However, those of ordinary skill in the art may proceed with a variety of the amount of resilient hooking members and the conducting pins, the connection way and the shape. For example, the detachment-preventing plug may comprise three conducting pins and three resilient hooking members, or one conducting pin and one resilient hooking member depending on practical needs, and no limitation is made herein.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. A detachment-preventing plug for plugging into a socket having at least one slot, comprising:

a body unit having an interior compartment;

a first and a second conducting pins partially disposed in the interior compartment of the body unit, wherein the first conducting pin has a slot;

a slider member slidably disposed in the interior compartment of the body unit; and a first resilient hooking member is partially disposed in the body unit, the first resilient hooking member establishes a hooking configuration upon the insertion of the first and the second conducting pins into the socket slot;

wherein the first resilient hooking member has an exposing hooking end and a protruding portion, the exposing hooking end of the first resilient hooking member correspondingly aligns the slot of the first conducting pin, and the protruding portion of the first resilient hooking member protrudes toward the abutting surface of the slider member;

whereby when the protruding portion of the first resilient hooking member is pushed by the abutting surface of the slider member, the first resilient hooking member establishes a releasing configuration upon the deflection of the exposing hooking end into the slot of the first conducting pin.

2. The detachment-preventing plug as claimed in claim 1, wherein the second conducting pin has a slot; and a second resilient hooking member is partially disposed in the body unit, the second resilient hooking member establishes a hooking configuration upon the insertion of the first and the second conducting pins into the socket slot; wherein the second resilient hooking member has an exposing hooking end and a protruding portion, the exposing hooking end of the second resilient hooking member correspondingly aligns the slot of the second conducting pin, and the protruding portion of the second resilient hooking member protrudes toward the abutting surface of the slider member; whereby when the protruding portion of the second resilient hooking member is pushed by the abutting surface of the slider member, the second resilient hooking member establishes a releasing configuration upon the deflection of the exposing hooking end into the slot of the second conducting pin.

3. The detachment-preventing plug as claimed in claim 1, further comprising a button, wherein the button is connected to the slider and adapted to drive the slider.

4. The detachment-preventing plug as claimed in claim 1, wherein the body comprises an elastic element, two opposite ends of the elastic element are connected to the body and the slider respectively, and the elastic element holds the slider in an initial position.

5. A detachment-preventing plug for plugging into a socket having at least one slot, comprising:

a body unit having an interior compartment;

a first and a second conducting pins partially disposed in the interior compartment of the body unit, wherein the first conducting pin has a slot;

a slider member slidably disposed in the interior compartment of the body unit, the slider member has a first engaging end; and a first resilient hooking member is partially disposed in the body unit, the first resilient hooking member establishes a hooking configuration upon the insertion of the first and the second conducting pins into the socket slot;

wherein the first resilient hooking member has an exposing hooking end and a protruding portion, the exposing hooking end of the first resilient hooking member correspondingly aligns the slot of the first conducting pin, the protruding portion of the first resilient hooking member protrudes toward the slider member so as to engaged with the first engaging end of the slider member;

whereby when the protruding portion of the first resilient hooking member is pushed by the first engaging end of the slider member, the first resilient hooking member establishes a hooking configuration upon the deflection of the exposing hooking end into the slot of the first conducting pin.

6. The detachment-preventing plug as claimed in claim 5, wherein the second conducting pin has a slot; the slider member has a second engaging end; and a second resilient hooking member is partially disposed in the body unit; wherein the second resilient hooking member has an exposing hooking end and a protruding portion, the exposing hooking end of the second resilient hooking member correspondingly aligns the slot of the second conducting pin, and the protruding portion of the second resilient hooking member protrudes toward the second engaging end of the slider member so as to engaged with the second engaging end of the slider member; whereby when the protruding portion of the second resilient hooking member is pushed by the second engaging end of the slider member, the second resilient hooking member establishes a hooking configuration upon the deflection of the exposing hooking end into the slot of the second conducting pin.

7. The detachment-preventing plug as claimed in claim 5, further comprising a button, wherein the button is connected to the slider and adapted to drive the slider.

8. The detachment-preventing plug as claimed in claim 5, wherein the body comprises an elastic element, two opposite ends of the elastic element are connected to the body and the slider respectively, and the elastic element holds the slider in the initial position.

* * * * *